United States Patent [19]

Hosterman et al.

[11] 4,251,998

[45] Feb. 24, 1981

[54] HYDRAULIC REFRIGERATION SYSTEM AND METHOD

[75] Inventors: Craig Hosterman, Scottsdale; Warren Rice, Tempe, both of Ariz.

[73] Assignee: Natural Energy Systems, Tempe, Ariz.

[21] Appl. No.: 12,597

[22] Filed: Feb. 16, 1979

Related U.S. Application Data

[63] Continuation-in-part of Ser. No. 862,119, Dec. 19, 1977, Pat. No. 4,157,015.

[51] Int. Cl.[3] ..... F25B 1/00; F25B 1/06

[52] U.S. Cl. ..... 62/115; 62/114; 62/500

[58] Field of Search ..... 62/115, 116, 119, 122, 62/260, 498, 500, 514 R, 467 R, 114, 121

[56] References Cited

U.S. PATENT DOCUMENTS

| | | | |
|---|---|---|---|
| 1,781,051 | 11/1930 | Carrier | 62/114 |
| 1,882,256 | 10/1932 | Randel | 62/500 X |
| 2,152,663 | 4/1939 | Randel | 62/500 |
| 2,191,864 | 2/1940 | Schaefer | 62/119 |
| 2,751,762 | 6/1956 | Colton | 62/114 X |
| 3,789,617 | 2/1974 | Rannow | 62/115 |
| 3,848,424 | 11/1974 | Rhea | 62/115 |
| 4,078,392 | 3/1978 | Kestner | 62/114 |

*Primary Examiner*—Lloyd L. King

*Attorney, Agent, or Firm*—Cahill, Sutton & Thomas

[57] ABSTRACT

A refrigerant fluid is entrained within a down pipe of a closed loop water flow circuit to compress the refrigerant fluid from a gaseous state to a liquid state. A separation chamber at the lower extremity of the down pipe separates the liquid refrigerant fluid from the water and the water is drawn off. The water flows upwardly through a return pipe and pump, through a pipe for reintroduction to the down pipe at the upper end thereof. The drawn off liquid refrigerant flows upwardly through a return pipe, through a liquid refrigerant pump and through an expansion valve. The refrigerant fluid, converted to a mixture of vapor and liquid, called a "quality mixture of the refrigerant" by the expansion valve, flows through an evaporator to cool a medium, such as air, passing therethrough. The refrigerant fluid, flowing from the evaporator and in a gaseous state, is introduced to the upper end of the down pipe for re-entrainment in the water flowing into the down pipe.

25 Claims, 6 Drawing Figures

HYDRAULIC REFRIGERATION SYSTEM AND METHOD

The application is a continuation-in-part application of our copending application entitled "Hydraulic Refrigeration System and Method", filed on Dec. 19, 1977, and assigned Ser. No. 862,119, now U.S. Pat. No. 4,157,015.

The present invention relates to refrigeration systems and, more particularly, to refrigeration systems which do not require mechanical compressors to compress or conventional condensers to condense the refrigerant fluid.

The principle of entrapping and compressing air by movement of water, i.e. using a hydraulic air compressor or "trompe", as it is called, has been employed industrially in the United States for some years. In one such installation, air is drawn into a down flowing stream of water and trapped within a cavernous underground chamber where the head of water maintains it under compression. The air may be permitted to escape through a pneumatic engine or turbine; thus, power may be generated.

Various proposals have been made in the prior art to use the abundant wave energy of the sea for producing power. Because of the potential power available from the ocean, many ingenious suggestions have been made for harnessing some of the power. Among such suggestions are some that include generation of electricity, as described in U.S. Pat. No. 3,064,137. Therein, it is suggested that the energy of the ocean waves be used to cyclically feed a down pipe and entrap a column of air. The column is replenished and repressurized from wave to wave. The compressed air is finally expanded through a turbine driving an electrical generator to produce electrical energy storable in a battery. U.S. Pat. No. 3,754,147, describes a related system wherein the electricity generated is employed for electrolysis purposes.

In refrigeration systems, the major operating costs arise from the costs attendant energization of a mechanical compressor to compress the refrigerant. Additionally, the cost of such a compressor is a substantial part of the initial cost of the refrigeration system itself. Thus, it would be beneficial from the standpoint of both initial and operating costs to eliminate the need for a mechanical compressor in a refrigeration system.

The present invention is directed to a refrigeration system which employs the principles of operation of a "trompe" system for effecting the necessary compression of the refrigerant fluid. To provide the requisite head to the water and effect compression of the refrigerant fluid, a pump is employed. While the initial and operating costs of such a pump are not insignificant, these costs are substantially less than the cost associated with a compressor. Thereby, the major costs attendant refrigeration systems are substantially reduced by the present invention.

It is therefore a primary object of the present invention to eliminate the need for a mechanical compressor in a refrigeration system.

Another object of the present invention is to provide an inexpensive refrigeration system.

Yet another object of the present invention is to provide a hydraulic flow system for compressing the refrigerant fluid of a refrigeration system.

Still another object of the present invention is to provide a refrigeration system having a closed loop water system for compressing the refrigeration fluid in a closed loop refrigeration system.

A further object of the present invention is to provide a means for entraining a refrigerant fluid within a downward flow of water to effect compression and condensation of the refrigerant fluid.

A yet further object of the present invention is to provide a means for compressing and condensing the refrigerant fluid of a refrigeration system to entraining the refrigerant fluid within a downward flow of water, compressing the refrigerant fluid and separating the compressed refrigerant fluid from the water.

These and other objects of the present invention will become apparent to those skilled in the art as the description thereof proceeds.

The present invention may be described with greater specificity and clarity with reference to the following drawings, in which:

FIG. 1 is a schematic diagram of the hydraulic refrigeration system;

FIG. 1*a* is a fragmentary view of a variant for entraining the refrigerant fluid in the carrier;

Figure 1:
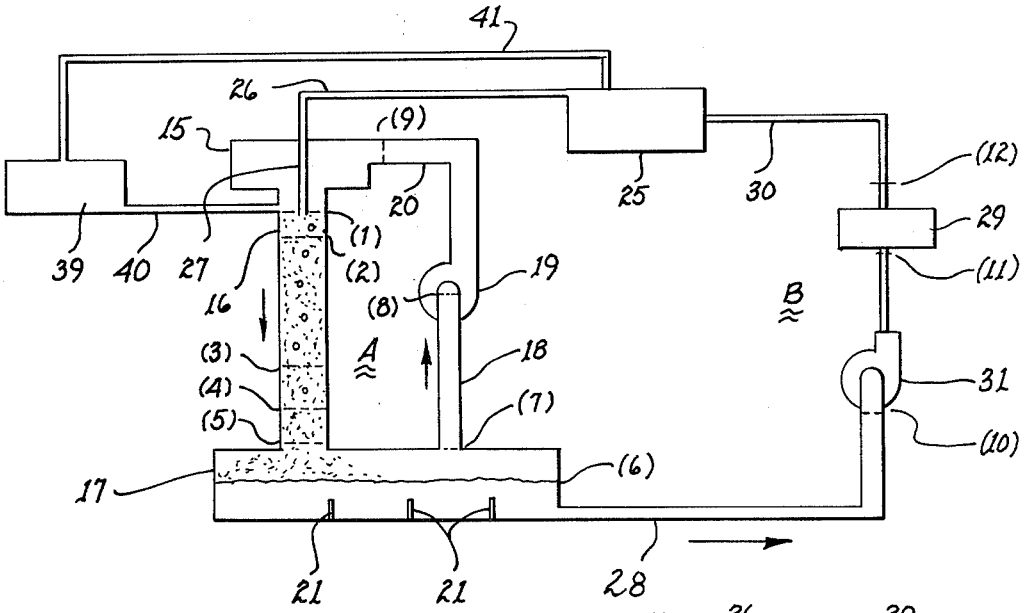

Referring to FIG. 1, there is shown a hydraulic refrigeration system divisible into two coacting interrelated subsystems, a water system A and a refrigeration system B. The water system includes a plenum 15 in fluid communication with the upper end of a down pipe 16. The lower end of the down pipe feeds a separation chamber 17. The chamber may be rectangular, as shown, hopper shaped or trough shaped. A return pipe 18 extends upwardly from the separation chamber and serves as a water conduit to a water pump 19. The output from the water pump is transmitted through pipe 20 into plenum 15.

Hydraulic refrigeration system B includes an evaporator 25 in which the cooled refrigerant fluid absorbs heat from a medium to be cooled (such as air) passing therethrough. The refrigerant fluid flowing out of the evaporator and through pipe 26 is in a gaseous state and generally superheated. Outlet 27 of pipe 26 is disposed in proximity to the inlet to down pipe 16. For reasons which will be discussed in further detail below, the gaseous refrigerant fluid discharged through outlet 27 will become entrained within the water flowing downwardly therepast into and through down pipe 16. Thereby, the refrigerant fluid is conveyed to separation chamber 17.

Within the separation chamber, the refrigerant fluid, being in a liquid state and for most types of refrigerants more dense than water, will tend to settle at the bottom of the separation chamber. Because of the pressure present within separation chamber 17, induced by the head of the water in down pipe 16, the refrigerant fluid, in a liquid state, is forced through pipe 28 through the liquid refrigerant pump 31, and on to expansion valve 29. The term "pressure" as related to the "head of water" is in fact substantially more complex. The true or actual pressure is related to the head of water and bubbles and to dynamic conditions. However, as there is no simple way to make a correct statement without mathematical analysis, the terms, as used above, will be used for reasons of simplicity. The refrigerant fluid approaching the expansion valve is caused to be liquid by being highly pressurized by a liquid refrigerant pump 31. The high pressure also prevents any water carried into the freon return pipe from floating at the top of the freon column and forces any such water through the expansion valve and the evaporator into the downpipe. After the expansion valve, the refrigerant is partly vapor and mostly liquid, called "low quality mixture state" and its temperature is low and corresponds to the refrigeration temperature. The pressure after the expansion valve is not necessarily low, although it is the lowest pressure in the system. It is the pressure corresponding with the desired temperature in the evaporator in the "saturation property tables" for whatever refrigerant is in use, as is well known. The cooled refrigerant fluid flows from expansion valve 29 through pipe 30 into the inlet of evaporator 25.

A surge tank 39 is connected to a point near the top of downpipe 16 by a conduit 40. A further conduit 41 interconnects the top of the surge tank with evaporator 25. AS the refrigeration load changes at the evaporator the volume of bubbles of refrigerant (freon) will increase. Thus, the surge tank allows water to leave or enter system A, as required, to keep the volume of water and freon constant. Conduits 40 and 41 allow the water level in the surge tank to vary with very nearly constant pressure being maintained in the surge tank.

Expansion valve 29 may be of any one of several physical forms and several control modes for it are possible. One particular type is, however, preferred and is known as a "constant superheat expansion control valve". In operation, it maintains a specific temperature of the refrigerant (freon) leaving the expansion valve regardless of the pressure of the liquid refrigerant (freon) supplied to the valve.

From the above description, it will become apparent that water system A is a simple closed loop system for developing a downward flow through down pipe 16 and a pressure within separation chamber 17 commensurate with the head of the column of water. Refrigeration system B includes a liquid refrigerant pump 31, conventional expansion valve 29 and evaporator 25. The function performed by conventional condensers and compressors are achieved by down pipe 16 and separation chamber 17, as will be described in detail below.

Figure 1A:
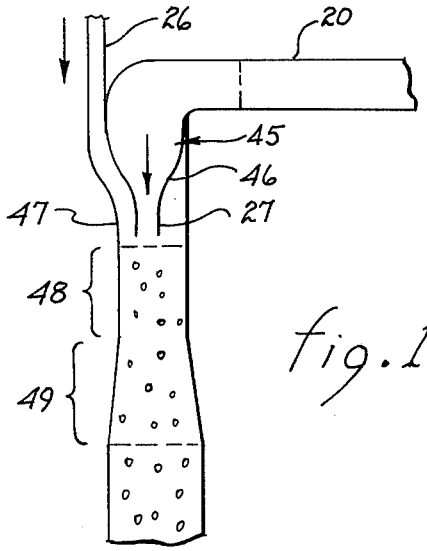

The refrigerant fluid, hereinafter referred to by the term "freon", is in a superheated gaseous state at the point of discharge through outlet 27. On discharge, the freon is injected into the water within down pipe 16 in the form of bubbles. These bubbles become entrained within the downward flow of water in proximity to outlet 27. Entrainment of the bubbles can be promoted by incorporating a liquid jet pump 45, as shown in FIG. 1*a*. Herein, the water flowing through pipe 20 is accelerated by forcing it through a nozzle 46 terminating at outlet 27 and discharging the water downwardly into pipe 16. The gaseous freon flowing through pipe 26 is discharged through an annular outlet 47 surrounding outlet 27. The accelerated water flow entrains the freon in a constant diameter section 48 wherein full entrainment occurs. Downstream in section 49, pipe 16 enlarges in diameter resulting in a reduced flow rate and a substantial pressure increase. The benefit achieved with the liquid jet pump is that of increasing the pressure at location (2) over that obtained from the apparatus shown in FIG. 1. Thus, the downpipe can be shorter and less depth is necessary. However, water-jet pumps are relatively inefficient and the overall efficiency of the system may be degraded.

The entrained bubbles shortly acquire the same temperature and pressure as the surrounding water in pipe 16. These bubbles are carried downwardly by the water due to their entrainment therein. The bubbles have an upward drift velocity relative to the water, which drift is at a lower velocity than the downward water flow velocity. Continuing downward movement of the bubbles results in a pressure increase commensurate with the depth or head of water at any given location. At some location along down pipe 16, represented by numeral (3), the ambient pressure corresponds with the saturation pressure for the freon at the there existing temperature. Accordingly, the freon will undergo a change of state from gas to liquid. The change of state or condensation process is heat transfer rate controlled through the absorbtion of heat by the surrounding water and a quiescent temperature is achieved at location (4). At location (5), all of the freon is in the state of liquid droplets dispersed within the water, which droplets are at the same temperature as the water and more dense, in case the refrigerant is freon, than the water. Consequently, the drift velocity of the freon is now downward relative to the water flow velocity.

The mixture of liquid freon and water enters separation chamber 17. Herein, the flow is stilled to some extent with or without the use of baffle means 21 and a flow direction change occurs. The combination of flow stilling and flow direction change tends to encourage separation of the liquid freon and water such that the freon will gravitate to the bottom of the chamber. The water is drawn from chamber 17 by pump 19 through pipe 18 and ultimately conveyed into plenum 16. The vertical location of pump 19 is selected so as to prevent pump inlet cavitation.

The liquid freon within separation chamber 17 is expelled therefrom into pipe 28 due to the pressure head created primarily by the water in down pipe 16, and enters as a liquid at location (10) liquid refrigerant pump 31. The pump increases the pressure of the freon to a large enough value to insure that the freon is still entirely liquid at location (11), just before the expansion valve. The expansion valve 29, disposed in the path of the freon, reduces the pressure and temperature thereof to a value commensurate with that desired in the evaporator. Within the evaporator, freon, entering as a quality mixture, absorbs heat from the medium passing therethrough and the freon becomes at least slightly superheated vapor.

Since heat is continually transferred from the freon within down pipe 16 to the surrounding water, the temperature of the water will rise unless the heat can be transferred to a heat sink. The requisite heat sink may be provided by the earth surrounding water system A in the event the latter is buried within the ground; alternatively, cooling fins may be employed to transfer heat to the ambient air. Other forms of heat sinks are well known and may also be incorporated.

The hydraulic refrigeration system may be considered a cycle-type refrigeration system in the conventional thermodynamic sense. That is, work is added to the cycle by the pumps, heat is rejected from the cycle by the down pipe to the surrounding earth or other heat exchanger and heat is added to the cycle at the evaporator. Accordingly, the cycle described is in accord with the second law of thermodynamics from both the qualitative and quantitative standpoints.

In analyzing the present invention from the thermodynamic standpoint, several observations may be made. The compression and heat rejection phases of a refrigeration system are simultaneously performed in the down pipe. The water pump and the liquid refrigerant pump are the only moving parts of the system. Compression of the freon is virtually isothermal at the water temperature, which is the preferred compression process and superior to the irreversible adiabatic process performed by a conventional freon compressor. Finally, the earth or ground is useable as a heat sink.

It is not possible to arbitrarily choose the thermodynamic conditions to be achieved at the various locations within the refrigeration system and thereafter calculate the performance of the system. Instead, one must choose the temperature preferred at the evaporator and the amount of refrigeration wanted; thereafter, all other parameters of the system are determinable by calculation to assure satisfaction of the first law of thermodynamics, the law of conservation of momentum and of conservation of mass.

In the following analysis, the equations are statements of satisfaction of the above identified laws and all of the equations together constitute a mathematical model of the hydraulic refrigeration system. Various idealizations are necessarily incorporated into such a model and may be slight departures from reality. The primary idealization in the following mathematical analysis is one-dimensionality of the flow.

In the following analysis, various symbology is used and a legend therefore appears below:

NOMENCLATURE subscripts

F—freon
l—liquid (water)
numbers→stations shown in schematic diagram
WP—Water pump
FP—freon pump
u—water return pipe
d—down pipe
t—freon supply pipe at station 1
f—liquid phase of freon
fg—latent value for evaporation of freon
R—reference value
r—relative to water velocity
B—buoyant
D—drag
REF—refrigeration

ALPHABETIC

A—cross-sectional area
$C_d$—drag coefficient
d—differential operator
D—droplet diameter
F—force
g—gravitational constant
$h_{LETTER}$—enthalpy
$h_{NUMBER}$—vertical distance
$Q_{REF}$—refrigeration
$K_{NUMBERS}$—entrance loss coefficient or pressure recovery coefficient
m—mass flow rate
p—pressure
S—circumference
T—temperatures
v—specific volume
V—velocity
x—quality
z—coordinate

FOREIGN AND/OR SPECIAL

COP—coefficient or performance
Δ—difference operator
¶ —power
f—fluid friction factor
ζ—density
μ—viscosity It is to be understood that while freon and water are a likely combination for use in a hydraulic refrigeration system, any other combination of carrier and refrigerant fluid that are not miscible could be used; in example, butane and water. Were a refrigerant such as butane, propane, etc. used the refrigerant, when liquid, would be less dense than the water. Accordingly, the refrigerant would rise to the top of separation chamber 17 and the inlets to pipes 18 and 28 would have to be reversed. Additionally, the entrained refrigerant in liquid state within pipe 16 would not drift downwardly relative to the water but would continue to drift upwardly which would necessitate a restatement of the formula attendant locations (4) to (5).

Because of its ready availability and low cost, water has been described as the carrier for a refrigerant. Another more dense carrier would however be preferred provided that the bubbles could be entrained therein and provided that it were not miscible with the refrigerant. Such a carrier would reduce the required depth of the system and thereby provide savings in construction and maintenance costs.

Mathematical modeling of the invention results in equations which must be solved simultaneously using a digital computer. The programming of the equations is such that all dimensions, pressures, temperatures, pump power, cycle performance, etc., are calculated automatically when the program is supplied with the freon designation, evaporator temperature and desired tonnage of refrigeration.

Figure 2:
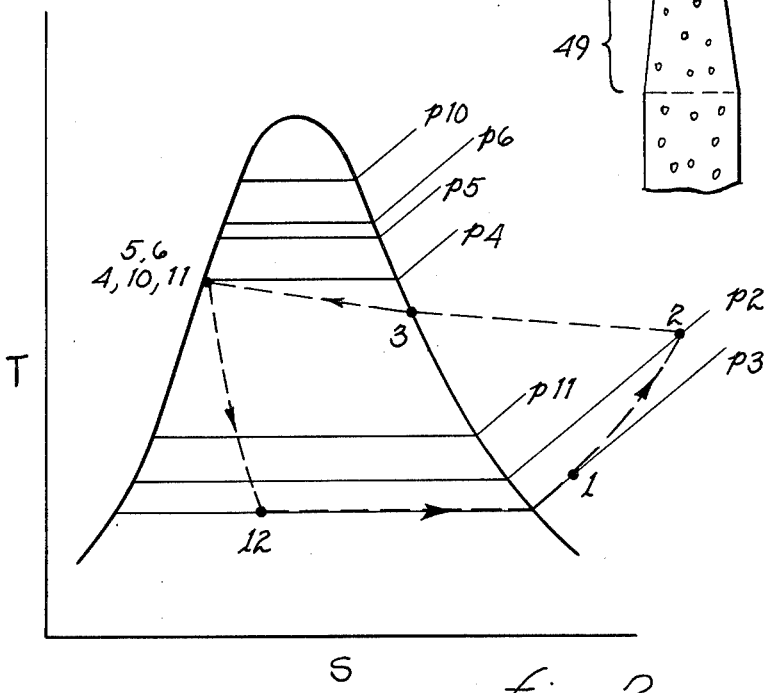
FIG. 2 is a thermodynamic state diagram representative of the hydraulic refrigeration system.

Mathematical modeling of the invention follows:

In addition to the above legend, numerals (0), (1), (2), (3), (4), (5), (6), (7), (8), (9), (10), (11), and (12) will be used to correlate the equations with locations upon the structure illustrated in FIG. 1 and the thermodynamic state diagram illlustrated in FIG. 2.

FLOW OF L PHASE FROM (0)→(1) IN DOWNPIPE JUST BEFORE ENTRAINMENT OF F PHASE $$\frac{P_o}{\zeta_l} + gh_{o1} = \frac{P_{l1}}{\zeta_l} + \frac{V_{l1}^2}{2} + K_{o1}\left(\frac{V_{l1}^2}{2}\right) \quad (1)$$

where $h_{01} > 0$ and $K_{01}$ is inlet loss coefficient for l phase at entrance to down pipe. (1) is the hydraulic form of energy conservation and momentum conservation (together). The conservation of mass equation is $$m_l = \zeta_l(A_d - A_t)V_{l1} \quad (2)$$

ENTRAINMENT PROCESS (1)→(2)

The flow is assumed isothermal. It is also assumed that $p_{l2}=p_{F2}=p_2$ and $T_{l2}=T_{F2}=T_1=T_2$. The momentum conservation equation is $$p_{F1}A_t+p_{l1}(A_d-A_t)-p_2A_d=m_lV_{l2}+m_F(V_{l2}-V_{R2})-m_lV_{l1}-m_FV_{F1} \quad (3)$$

The mass conservation equation is $$\dot{M}_F=\zeta_{F2}(V_{l2}-V_{r2})(Ad-\frac{\dot{M}_l}{\zeta_lV_{l2}}) \quad (4)$$

which is a combination of the conservation equations for the separate phases. In process (1)→(2), no energy equation (conservation of energy) is needed because the isothermal assumption is effectively a solution of the equation. In the computerized solution of the flow for process (1)→(2), equations (3) and (4) are solved simultaneously, iteratively, using freon properties from functional subroutines supplied by the freon vendor.

FLOW IN DOWN PIPE BELOW GAS ENTRAINMENT ZONE, WHILE VAPOR IS SUPERHEATED, (2)→(3)

Figure 3:
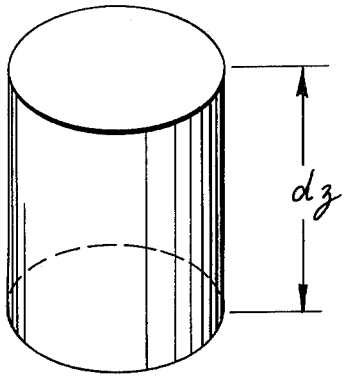
FIG. 3 is an illustration of a mathematical dimension.
Figure 4:
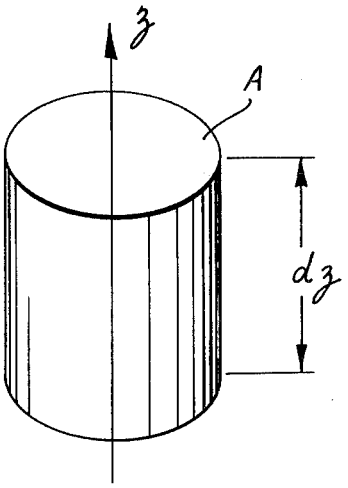
FIG. 4 is an illustration of mathematical dimensions.

The flow is treated as isothermal which eliminates the need for an explicit use of the equation of conservation of energy. An element of the downward flow is considered; in The computerized implementation of the analysis, the resulting finite difference equations are solved step wise, serially from (2)→(3). The computer program stops the process and gives the location of (3) when the pressure reaches the saturation pressure of freon at the water (and freon) temperature. It is assumed that $p_l=p_F=p$ and $T_l=T_p=T$ at any depth. $d_z>0$, (see FIG. 3), $g>0$ and $z>0$ downward. The equation for conservation of momentum is $$pAd-(p+dp)Ad+\zeta_FA_Fg\,dz+\zeta_lA_lg\,dz-\frac{f\zeta_lV_l^2Sd\,dz}{8}=\dot{M}_l(V_l+dV_l-V_l)+\dot{M}_F[(V_l-V_r)+d(V_l-V_r)-(V_l-V_r)] \quad (5)$$

and using the flow rate equations, $m=\zeta_lA_lV_l$ and $m_F=\zeta_FA_F(V_l-V_r)$ and $A_F+A_l=A_d$ and equation (5) becomes $$dpAd-\left[\frac{\dot{M}_l}{V_l}+\frac{\dot{M}_F}{(V_l-V_r)}\right]gdz+\frac{f\zeta V_l^2Sd\,dz}{8}+(\dot{M}_l+\dot{M}_F)dV_l-\dot{M}_FdV_r=0 \quad (6)$$

The equation for conservation of mass, with the same idealizations, becomes $$\frac{d\zeta_F}{\zeta_F}-\frac{dV_r}{(V_l)-V_r)}+\left[\frac{1}{V_l-V_r}+\frac{1}{V_l\left(\frac{\zeta_lV_lAd}{\dot{M}_l}-1\right)}\right]dV_l=0 \quad (7)$$

It is necessary to solve equations (6) and (7) iteratively, using freon properties from the vendor-supplied subroutines, at every step of the step wise solution from (2)→(3). It is noted that fluid friction is fully accounted for by use of the friction factor f. Since f is a function of pipe roughness and local Reynolds number, these items are used locally in an iterative manner in the computerized solution.

It is assumed that freon bubbles drift upward relative to the water at a drift velocity which depends on relative density difference between water and freon and on bubble size. It is assumed (idealized) that all bubbles are the same size and density at a given depth and that bubble size and density vary with depth; thus, the changing bubble velocity relative to the water is accounted for in the modeling. The details of this feature follow. The bubble is in equilibrium under the action of a bouyant force and a fluid - mechanical drag force:

$$F_8=(\zeta_l-\zeta_F)g\pi D^3/6$$

$$F_D=\frac{C_D{}^1\zeta_lD^2V_r{}^2\pi}{8}$$

$$C_D=\frac{24\mu_l}{\zeta_lV_rD}$$

and at equilibrium conditions, these result in $$V_r=\frac{(\zeta_l-\zeta_F)gD^3}{18\,\mu_l} \quad (8)$$

The reference condition R is introduced; some imperical information must be used at the reference state. In the computer program, the fact that $V_{rR}=0.8$ ft/sec., as shown from experiment, is the reference state knowledge introduced. Since the mass of each bubble is conserved during its downward travel $$\frac{\pi\zeta_FD^3}{6}=\frac{\pi\zeta_{FR}D_R{}^3}{6}$$

which results in $$D^2=\frac{18V_{rR}\mu_l}{(\zeta_l-\zeta_{FR})g}\left(\frac{\zeta_{FR}}{\zeta_F}\right)^{\frac{2}{3}}$$

which when entered into equation (8) gives $$V_r=V_{rR}\left(\frac{\zeta_l-\zeta_F}{\zeta_l-\zeta_{FR}}\right)\left(\frac{\zeta_{FR}}{\zeta_F}\right)^{\frac{2}{3}} \quad (9)$$

This describes how the local $V_r$ changes from the reference value of $V_r$ due to changes in diameter and density of the freon bubbles as they travel downward.

At state (3) the freon bubbles are saturated vapor condition.

FLOW IN DOWN PIPE; FROM THE LOCATION AT WHICH FREON IS SATURATED VAPOR TO THE LOCATION AT WHICH IT IS SATURATED LIQUID (3)→(4)

Flow is assumed isothermal, thus satisfying the law of conservation of energy. It is also assumed that $p_{l3}=p_{F3}=p_3$ and $T_{l3}=T_{F3}=T_3$ and $p_{l4}=p_{F4}=p_4$ and $T_{l4}=T_{F4}=T_3T_4$. It is assumed that $\zeta_{F4}$ is a function of T only. The equation for conservation of momentum is $$p_3A_d-p_4A_d+\zeta_lA_dgh_{34}=m_l(V_{l4}-V_{l3})+m_F[(V_{l4}-V_{r4})-(V_{l3}-V_{r3})] \quad (10)$$

and the equation for conservation of mass is $$\dot{M}_F = \zeta_{F4}(V_{l4} - V_{r4})\left(Ad - \frac{\dot{M}_l}{\zeta_l V_{l4}}\right) \tag{11}$$

These can be (and are in the computer program) solved simultaneously for conditions at state (4), in closed form (but still under the isothermal assumption).

Most of the heat that is transferred from the freon to the water is transferred during the freon condensation (3)→(4). Using the law of conservation of energy in approximate form, the temperature of the water at (4) is given by $$T_4 = T_3 + \frac{\dot{M}_F h_{FG@T_3}}{\dot{M}_l C_{vl}} \tag{12}$$

FLOW IN DOWN PIPE AFTER THE F PHASE IS LIQUID (4)→(5)

The freon is subcooled in this process, but no thermodynamic data for subcooled freon is existent. Therefore, the flow is considered as incompressible. It is assumed that $p_l = p_F = p$ and $T_l = T_F = T$, $V_{l4} = V_{l5}$ and $V_{F4} = V_{F5}$. Since the hydraulic (incompressible) assumption reduces the law of conservation of energy and law of conservation of momentum to the same expression, it is $$\dot{M}_l\left(\frac{V_{l4}^2}{2} + gh_{45} + \frac{P_4}{\zeta_l}\right) + \dot{M}_F\left(\frac{V_{F4}^2}{2} + gh_{45} + \frac{P_4}{\zeta_{F4}}\right) = \dot{M}_l\left(\frac{V_{l5}^2}{2} + O + \frac{P_5}{\zeta_l}\right) + \dot{M}_F\left(\frac{V_{F5}^2}{2} + O + \frac{P_5}{\zeta_{F5}}\right) + \dot{M}_l\left(\frac{fV_l^2\zeta_l h_{45}}{2D_o}\right) \tag{13}$$

Clearly fluid friction is accounted for by the use of f as a function of the local Reynolds number. In the computer program, equation (13) is solved together with the equation of conservation of mass, to get $p_5$, $V_{l5}$ and $V_{F5}$.

EXITING OF MIXTURE FROM DROPWISE AND SEPARATION OF THE FREON PHASE (5)→(6)

There is a 'pressure recovery coefficient', $K_{56}$. It is assumed that the separation chamber is large enough that fluid friction for the motion through the chamber can be neglected; thus, the freon-water interface is a horizontal line. For $h_{56} > 0$ when (6) is below (5) and for incompressible flow, the conservation of energy equation (which is also the conservation of momentum equation) is $$\dot{M}_l\left(\frac{P_5}{\zeta_l} + \frac{V_{l5}^2}{2} + gh_{56}\right) + \dot{M}_F\left[\frac{P_5}{\zeta_F} + \frac{(V_{l5} - V_{r5})^2}{2} + gh_{56}\right] = \dot{M}_l\left(\frac{P_6}{\zeta_l} + O + O\right) + \dot{M}_F\left(\frac{P_6}{\zeta_F} + O + O\right) + (1 - K_{56})\dot{M}_l\frac{V_{l5}^2}{2} - (1 - K_{56})\dot{M}_F\frac{(V_{l5} - V_{r5})^2}{2} \tag{14}$$

In implementation of this equation, together with the law of conservation of mass equation (5)→(6), all terms due to the F phase were dropped since they are very small compared with those due to the l phase. Thus the equations used were $$P_6 = P_5 + \zeta_l g h_{56} + \zeta_l K_{56}\frac{V_{l5}^2}{2}$$

and $$V_6 = 0 \tag{15}$$

FLOW OF L PHASE FROM SEPARATION TANK INTO LOWER END OF WATER RETURN PIPE, (6)→(7)

In the water return pipe, the velocity is constant and is given by equation of conservation of mass as $$V_7 = \frac{\dot{M}_l}{\zeta_l A \mu} \tag{16}$$

The equation of conservation of energy (or momentum, since water is incompressible) is $$P_7 = P_6 - \zeta_l g h_{67} - \zeta_l(1 + K_{67})\frac{V_7^2}{2}$$

where $h_{67} > 0$ for (7) above (6) and where $K_{67}$ is an entrance loss coefficient.

FLOW OF L PHASE IN WATER RETURN PIPE TO PUMP INLET, (7)→(8)

The fluid is incompressible, the Reynolds number and f are constant, the flow is isothermal. The applicable equations are $$\frac{P_7}{\zeta_l} + \frac{V_7^2}{2} + O = \frac{P_8}{\zeta_l} + \frac{V_8^2}{2} + \frac{f_{78}V_7^2 h_{78}}{2D\mu} + gh_{78} \tag{17}$$

but $V_7 = V_8$ if the pipe is of constant diameter. Also, $p_8$ is to be specified as a pressure large enough to prevent pump inlet cavitation (say, atmospheric pressure). To compute the pump inlet location within the program, the proper equation is $$h_{78} = \frac{1}{\zeta_l}\left(\frac{P_7 - P_8}{\frac{f_{78}V_7^2}{2D\mu} + g}\right) \tag{18}$$

FLOW IN THE WATER RETURN PIPE FROM PUMP INLET TO (0) IN THE PLENUM (8)→(9)→(0)

The pressure recovery factor at the pipe exit (into the plenum) is $K_{89}$. $K_{89} > 0$. We assume a pressure increase across the pump of $\Delta p_p$ is assumed. Then, since the fluid is incompressible, the conservation of energy equation (or mementum) is $$\frac{P_8}{\zeta_l} + \frac{V_8^2}{2} + O = \frac{P_9}{\zeta} + \frac{V_9^2}{2} + gh_{89} + \frac{f_{89}V_8^2 h_{89}}{2D\mu} - \frac{\Delta P_p}{\zeta_l} - K_{89}\frac{V_8^2}{2} \tag{19}$$

In the computerized calculations, this is solved for $\Delta p_p$, using $V_8 = V_9$.

FLOW OF FREON IN FREON RETURN PIPE (6)→(11)

The freon is in a thermodynamic subcooled state in this flow, but is considered as an incompressible fluid since no subcooled property data exists. The applicable conservation equations are $$\dot{M}_F = \zeta_F A_{FR} V_{10} \tag{20}$$

and $$\frac{P^6}{\zeta_F} + O + O = \frac{P_{11}}{\zeta_F} + \frac{V_{11}^2}{2} + gh_{611} + \frac{f_{611} h_{611} V_{11}^2}{2D_{FR}} - \frac{\Delta P_{FP}}{\zeta_F} \tag{21}$$

and are solved for $\Delta p_{Fp}$ after assuming a reasonable velocity for the freon and assuming a value of $P_{11}$ large enough to assure that the freon will remain liquid at (11); the freon return pipe size is also calculated.

EXPANSION VALVE FLOW (THROTTLE), (11)→(12)

Kinetic energy change is neglected and potential energy change is neglected. Hence, the applicable equation is $$h_{F11} = h_{F12} = hf_{F12} + x_{F12} hfg_{12}$$

This is used to solve for $x_{12}$. The temperature in the evaporator ($T_{12}$) being prescribed as input data, $p_{12}$ is known to be the corresponding saturation pressure for freon.

The above outline of the mathematical model indicates equations that are sufficient in the computer program to calculate all pressures, temperatures, energy states, velocities, flow rates, and pipe sizes throughout the system, for any specified freon type, refrigeration tonnage, and evaporator pressure (temperature). The computer program carries out the calculations and prints the results.

From the calculated state values, all interesting performance quantities can be calculated as follows.

REQUIRED PUMP POWER

Neglect changes in potential energy and kinetic energy and consider the water as incompressible. Then $$¶ = \dot{M}\left(\frac{\Delta P_P}{\zeta_l}\right) \tag{22}$$

REFRIGERATION OBTAINED

Neglect changes in potential energy and kinetic energy and the energy equation applied to evaporator yields $$Q_{REF} = \dot{m}(h_{F1} - h_{F12}) \tag{25}$$

where $$h_{F12} = hf_{F12} + x_{F12} hfg_{F12}$$

and $h_{F1}$ = enthalpy of superheated freon leaving the evaporator

COEFFICIENT OF PERFORMANCE (COP)

$$COP = \dot{Q}_{REF}/¶$$

when adjusted to be free of units.

POWER REQUIRED

The quantity (hp/ton) is also an interesting quantity and is calculated as follows:

$$\text{Hp/ton} = \frac{¶}{\dot{Q}_{REF}},$$

where units on right side are horsepower and tons for power and refrigeration, respectively.

In summary of the mathematical model described above, the performance values do not consider pump efficiency or air circulating fan power; however, these efficiencies are simple to incorporate by simple manual calculation. All other real world inefficiencies are accounted for with the level of the idealization given in the introduction to the mathematical analysis.

Figure 5:
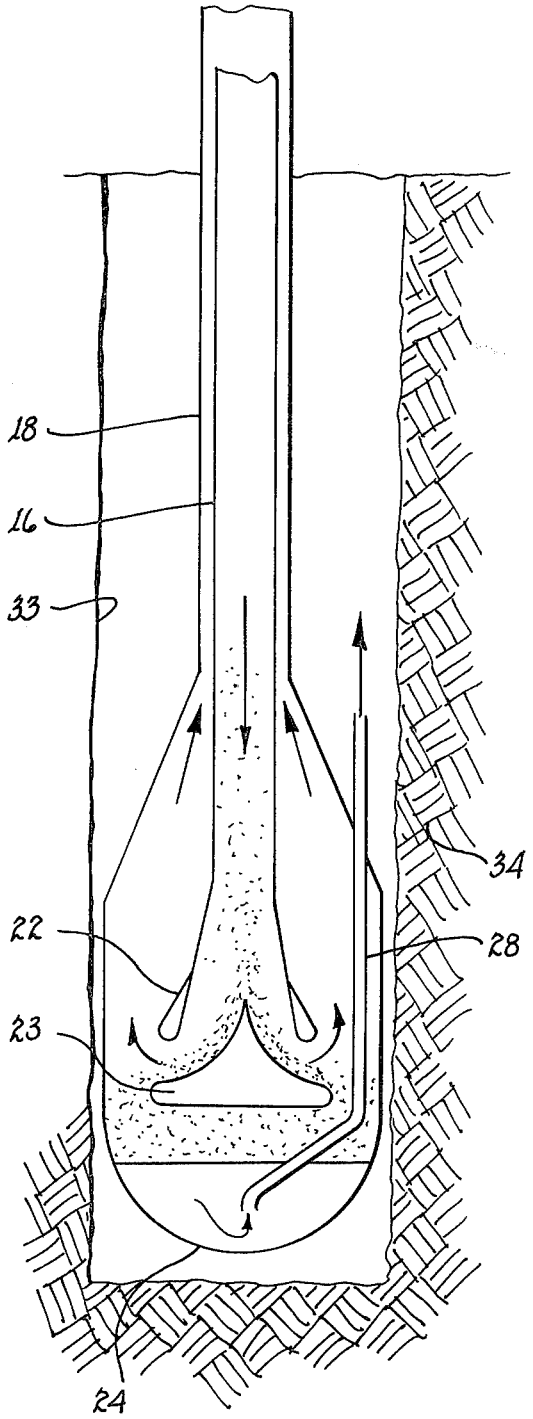
FIG. 5 is a variant of the down pipe and return pipe construction.

A variant of a part of the present invention is illustrated in FIG. 5. Herein, the return pipe is configured concentric with the down pipe and the separation chamber is a bulbous lower end of the return pipe.

In particular, the lower end of down pipe 16 includes a radially expanded skirt 22 to accommodate a partially inserted cone-like flow director 23. The lower end of return pipe 18 includes a bulbous chamber 24 for receiving the lower end of the down pipe and the flow director. The lower end of pipe 28 is disposed at the bottom of bulbous chamber 24. The unit described above may be lodged within a shaft 33 in earth 34.

In operation, the water and entrained freon flow downwardly through the down pipe until it becomes radially dispersed by the flow director. The radial dispersion, in combination with the baffle-like operation of the flow director, tends to still the flow rate and urge separation of the liquid freon from the water. The liquid freon will settle at the bottom of the bulbous chamber; therefrom, it will be drawn off through pipe 28. The separated water will flow upward through the annular passageway defined by down pipe 16 and return pipe 18.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. Apparatus for compressing and withdrawing heat from the refrigerant fluid in a refrigeration system, which refrigeration system includes an expansion valve and an evaporator, said apparatus comprising in combination:

(a) a down pipe, including a plenum disposed at the upper end thereof, for conveying the refrigerant fluid downwardly;

(b) a fluid non-miscible with the refrigerant fluid;

(c) means for introducing the non-miscible fluid into said down pipe and urge downward flow therethrough;

(d) means for conveying the refrigerant fluid from the evaporator to said down pipe;

(e) means for entraining the refrigerant fluid within the non-miscible fluid flowing downwardly through said down pipe to convey the refrigerant fluid downwardly and compress the refrigerant fluid by the head of the non-miscible fluid into a liquid state;

(f) a separation chamber disposed at the lower end of said down pipe for receiving and segregating the refrigerant fluid and the non-miscible fluid;

(g) pipe means for withdrawing the refrigerant fluid from said separation chamber and conveying it to the expansion valve;

(h) pump means for maintaining the refrigerant fluid in a liquid state within said pipe means between said separtion chamber and the expansion valve;

(i) further pipe means for withdrawing the non-miscible fluid from said separation chamber; and (j) heat sink means for dissipating heat from the non-miscible fluid;

whereby, heat is withdrawn from the refrigerant fluid and the non-miscible fluid simultaneous with compression of the refrigerant fluid during downward flow thereof through said down pipe.

2. The apparatus as set forth in claim 1 including a surge tank connected in fluid communication with said down pipe.

3. The apparatus as set forth in claim 2 wherein said entraining means includes a water jet pump.

4. The apparatus as set forth in claim 1 wherein said entraining means includes an outlet disposed within and subjected to the flow forces attendant the flowing non-miscible fluid.

5. The apparatus as set forth in claim 4 wherein said outlet is disposed within said down pipe.

6. The apparatus as set forth in claim 5 wherein said separation chamber includes means for stilling the flow therethrough.

7. The apparatus as set forth in claim 6 wherein said further pipe means includes a pump for pumping the non-miscible fluid from said separation chamber to said introducing means.

8. The apparatus as set forth in claim 7 wherein the refrigerant fluid comprises freon and the non-miscible fluid comprises water.

9. The apparatus as set forth in claim 8 including a surge tank connected in fluid communication with said down pipe.

10. The apparatus as set forth in claim 1 wherein said further pipe means comprises a concentric pipe disposed about said down pipe.

11. The apparatus as set forth in claim 10 wherein said separation chamber comprises a closed end portion of said concentric pipe disposed beneath the lower end of said down pipe.

12. Apparatus for converting a gaseous refrigerant fluid expelled from an evaporator in a refrigeration system into a liquid refrigerant fluid introduced to an expansion valve of the refrigeration system by entraining the refrigerant fluid with a carrier non-miscible with the refrigerant fluid, said apparatus comprising in combination:

(a) means for entraining the gaseous refrigerant fluid with the carrier;

(b) a down pipe for conveying the carrier and the entrained refrigerant fluid downwardly and increasing the pressure thereof in proportion to the depth of said down pipe until the entrained gaseous refrigerant fluid is converted into entrained liquid refrigerant fluid;

(c) a separation chamber disposed at the lower end of said down pipe for receiving and segregating the downwardly flowing carrier and entrained refrigerant fluid;

(d) means for withdrawing the carrier from said separation chamber;

(e) means for conveying the refrigerant fluid from said separation chamber to the expansion valve; and (f) means for maintaining the refrigerant fluid in a liquid state while conveying it to the expansion valve.

13. The apparatus as set forth in claim 12 wherein said maintaining means comprises a pump.

14. The apparatus as set forth in claim 13 including a surge tank in fluid communication with said down pipe for accommodating variations in volume of gaseous refrigerant fluid.

15. The apparatus as set forth in claim 13 wherein said entraining means comprises a water jet pump.

16. The apparatus as set forth in claim 12 wherein said separation chamber includes means for stilling the flow therethrough.

17. The apparatus as set forth in claim 12 wherein said withdrawing means includes pump means for transporting the carrier to said entraining means.

18. The apparatus as set forth in claim 12 wherein the refrigerant fluid is freon and the non-miscible fluid is water.

19. The apparatus as set forth in claim 12 wherein said withdrawing means comprises a concentric pipe about said down pipe.

20. The apparatus as set forth in claim 19 wherein said separation chamber comprises a closed end portion of said concentric pipe disposed beneath the lower end of said down pipe.

21. A method for compressing and withdrawing heat from a refrigerant fluid within a refrigeration system having an evaporator and an expansion valve, said method comprising the steps of:

(a) establishing a downward flow of a fluid non-miscible with the refrigerant fluid within a down pipe;

(b) conveying the refrigerant fluid in a gaseous state from the evaporator to the upper end of the down pipe;

(c) entraining the refrigerant fluid within the downward flow of the non-miscible fluid to convert the refrigerant fluid to a liquid state;

(d) separating the refrigerant fluid from the non-miscible fluid at the lower end of the down pipe;

(e) transmitting the separated refrigerant fluid from the lower end of the down pipe to the expansion valve;

(f) maintaining the refrigerant fluid in a liquid state during said step of transmitting; and (g) dissipating heat from the refrigerant fluid within the down pipe;

whereby, the compression and heat dissipation phases of the refrigeration cycle are performed within the down pipe.

22. The method as set forth in claim 21 including the step of drawing and pumping the non-miscible fluid from the lower end of the down pipe to the upper end of the down pipe.

23. A method for converting a gaseous refrigerant fluid expelled from an evaporator in a refrigeration system into a liquid refrigerant fluid introduced to an expansion valve of the refrigeration system by entraining the refrigerant fluid with a carrier non-miscible with the refrigerant fluid, said method comprising the steps of:

(a) entraining the gaseous refrigerant fluid with the carrier;

(b) conveying the carrier and the entrained refrigerant fluid downwardly through a down pipe to increase the pressure thereof in proportion to the depth of the down pipe until the entrained gaseous refrigerant fluid is converted into entrained liquid refrigerant fluid;

(c) segregating the carrier from the liquid refrigerant fluid;

(d) withdrawing the segregated carrier;

(e) conveying the segregated liquid refrigerant fluid to the expansion valve; and (f) maintaining the refrigerant fluid in a liquid state during said step of conveying.

24. The method as set forth in claim 23 wherein said step of maintaining includes the step of pumping the liquid refrigerant fluid under pressure to the expansion valve.

25. The method as set forth in claim 24 including the step of accommodating for variation in the volume of gaseous refrigerant fluid caused by variation in the load placed upon the evaporator.

* * * * *